US005466556A

United States Patent [19]

Inaishi

[11] Patent Number: 5,466,556

[45] Date of Patent: Nov. 14, 1995

[54] PHOTOSENSITIVE MICROENCAPSULATED TONER

[75] Inventor: Kouji Inaishi, Okazaki, Japan

[73] Assignee: Brother Kogyo Kabushiki Kaisha, Nagoya, Japan

[21] Appl. No.: 225,298

[22] Filed: Apr. 8, 1994

[30] Foreign Application Priority Data

May 14, 1993 [JP] Japan ..... 5-113223

[51] Int. Cl.[6] ..... G03G 9/093

[52] U.S. Cl. ..... 430/138; 430/109

[58] Field of Search ..... 430/138, 281, 430/109

[56] References Cited

U.S. PATENT DOCUMENTS

| | | | |
|---|---|---|---|
| 2,548,366 | 4/1951 | Green et al. | 282/28 |
| 2,730,456 | 1/1956 | Green et al. | 117/36 |
| 2,800,457 | 7/1957 | Green et al. | 252/316 |
| 2,969,331 | 1/1961 | Brynko et al. | 252/316 |
| 3,111,407 | 11/1963 | Lindquist et al. | 96/27 |
| 3,281,383 | 10/1966 | Zelinski et al. | 260/23.7 |
| 3,287,154 | 11/1966 | Haas | 117/36.9 |
| 3,418,250 | 12/1968 | Vassiliades | 252/316 |
| 3,551,346 | 12/1970 | Breen | 252/316 |
| 3,576,660 | 4/1971 | Bayless et al. | 117/36.8 |
| 3,578,605 | 5/1971 | Baxter | 252/316 |
| 3,621,020 | 11/1971 | Ojakaar | 260/248 |
| 3,660,304 | 5/1972 | Matsukawa | 252/316 |
| 3,723,363 | 3/1973 | Shaw, Jr. | 260/2.5 |
| 3,726,803 | 4/1973 | Bayless et al. | 252/316 |
| 3,755,190 | 8/1973 | Hart et al. | 252/316 |
| 3,773,695 | 11/1973 | Argabright et al. | 260/2.5 |
| 3,775,424 | 11/1973 | Farber | 260/295 B |
| 3,788,994 | 1/1974 | Wellman et al. | 252/62.1 |
| 3,793,268 | 2/1974 | Dietrich et al. | 260/2.5 |
| 3,796,669 | 3/1974 | Kirtitani et al. | 252/316 |
| 3,803,046 | 4/1974 | Winyall et al. | 252/317 |
| 3,816,331 | 6/1974 | Brown, Jr. et al. | 252/316 |
| 3,864,400 | 2/1975 | Seibert | 260/570 D |
| 4,001,140 | 1/1977 | Foris et al. | 252/316 |
| 4,016,099 | 4/1977 | Wellman et al. | 252/316 |
| 4,025,455 | 5/1977 | Shackle | 252/316 |
| 4,079,066 | 3/1978 | Gardner | 260/345 |
| 4,085,648 | 4/1978 | Fricke et al. | 84/124 |
| 4,087,376 | 5/1978 | Foris et al. | 252/316 |
| 4,089,802 | 5/1978 | Foris et al. | 252/316 |
| 4,399,209 | 8/1983 | Sanders et al. | 430/138 |
| 4,416,966 | 11/1983 | Sanders et al. | 430/138 |
| 4,440,846 | 4/1984 | Sanders et al. | 430/138 |
| 4,497,885 | 2/1985 | Ushiyama et al. | 430/106.6 |
| 4,554,235 | 11/1985 | Adair et al. | 430/138 |
| 4,576,891 | 3/1986 | Adair et al. | 430/138 |
| 4,587,194 | 5/1986 | Adair et al. | 430/138 |
| 4,891,299 | 1/1990 | Yamada | 430/202 |
| 5,005,028 | 4/1991 | Tamura et al. | 346/76 |

FOREIGN PATENT DOCUMENTS

| | | |
|---|---|---|
| 879043 | 8/1971 | Canada . |
| 0088566A2 | 9/1983 | European Pat. Off. . |
| 418851A2 | 3/1991 | European Pat. Off. . |
| 51-132838 | 11/1976 | Japan . |
| 56-119138 | 9/1981 | Japan . |
| 57-124343 | 8/1982 | Japan . |
| 57-179836 | 11/1982 | Japan . |
| 57-197538 | 12/1982 | Japan . |
| 57-202547 | 12/1982 | Japan . |
| 58-38781 | 8/1983 | Japan . |
| 58-176643 | 10/1983 | Japan . |
| 60-57859 | 4/1985 | Japan . |
| 60-227161 | 11/1985 | Japan . |
| 62-162147 | 7/1987 | Japan . |
| 62-209444 | 9/1987 | Japan . |
| 63-32560 | 2/1988 | Japan . |
| 4-249250 | 9/1992 | Japan . |
| 927807 | 6/1963 | United Kingdom . |
| 930422 | 7/1963 | United Kingdom . |
| 965074 | 7/1964 | United Kingdom . |
| 990443 | 4/1965 | United Kingdom . |

*Primary Examiner*—John Goodrow
*Attorney, Agent, or Firm*—Oliff & Berridge

[57] ABSTRACT

A photosensitive microencapsulated toner includes a radical polymerizable unsaturated group-containing compound, a metal arene compound, a spectral sensitizing dye, and a photosensitizer. The toner is photocurable by application of low energy visible light, particularly at a wavelength of not shorter than 600 nm.

20 Claims, 1 Drawing Sheet

PHOTOSENSITIVE MICROENCAPSULATED TONER

BACKGROUND OF THE INVENTION

1. Field of the Invention

The present invention relates to toners for use in color copying machines such as electrophotographic systems and, more particularly, to photosensitive microencapsulated toners which are cured on exposure to light at a specific wavelength.

2. Description of the Related Art

Known color copying machines used with microcapsules can be broadly classified into two categories including electrophotographic systems and transfer development systems.

The electrophotographic systems make use of microencapsulated toners, wherein ink components are encapsulated, as disclosed in, for example, U.S. Pat. Nos. 3,788,994, 4,016,099 and 4,497,885, Japanese Patent Publication No. 51-35867, Japanese Unexamined Patent Publication Nos. 51-132838, 56-119138, 57-202547, 58-176643, 60-57859, 60-227161 and 63-32560, European Unexamined Patent Publication Nos. 88,566 and 418,851.

In color copying machines, four color toners including yellow, magenta, cyan and black toners are used to make images of the respective colors on a photosensitive material. The resultant image-wise toners are transferred to a material where images are to be transferred. The toner-transferred material is heated or pressed to fix the toners thereon.

On the other hand, transfer development systems make use of toner encapsulating photosensitive resins and dye ingredients as set forth, for example, in U.S. Pat. Nos. 2,548,366, 3,775,424, 3,864,400, 4,399,209, 4,085,648, 4,399,209, 4,440,846, 4,416,966, 4,554,235, 4,576,891, 4,587,194, 4,891,299 and 5,005,028 and Japanese Unexamined Patent Publication Nos. 57-124343, 57-179836, 57-197538, 62-162147 and 62-209444.

In color copying machines, three types of microcapsules are used, in which three dye precursors, dyes or pigments of yellow, magenta and cyan colors are, respectively, contained. The respective microcapsules have the following characteristics. The microcapsules containing a cyan chromogen are rendered solid upon exposure to light at a wavelength of approximately 650 nm (red light). On exposure to light at a wavelength of approximately 550 nm (green light), the microcapsules containing a magenta chromogen are rendered solid. Likewise, on exposure to light at a wavelength of approximately 450 nm (blue light), the microcapsules containing a yellow chromogen are rendered solid.

The uniformly coated sheet of these microcapsules on a support is applied with image-wise red, green and blue light radiations at once or after color separation. Hence, a latent image is formed. Thereafter, uncured microcapsules are ruptured by application of pressure or heat so that the encapsulated chromogens are transferred to a material on which a color developer has been coated.

In the electrophotographic systems used with the microencapsulated toner, however, four color toners have to be used, which in turn requires four toner tanks. This results in the apparatus being expensive. Moreover, four transfer steps are essential for one material where images are to be transferred, with the attendant disadvantage that color shift easily occurs.

On the other hand, transfer development systems are advantageous in that the number of steps is smaller than in electrophotographic systems, because analog exposure to light is possible in transfer development systems. However, since transfer development systems need photosensitive microcapsule-coated sheets and developer-coated materials, these systems consume an undesirably large quantity of materials. This raises copying costs. In addition, since the photosensitive microcapsule-coated sheet has to be kept in a cold and dark condition, a burden is placed on users in securing its storage space. Like once-through ribbons for thermal transfer, the photosensitive microcapsule-coated sheets have portions which are not reused after copying, which raises the possibility that a substantial portion of the sheet will be wasted.

Japanese Unexamined Patent Publication No. 4-249250 has proposed photosensitive microencapsulated toners which solve all of the above problems.

Nevertheless, in view of the recent trend toward higher speed operation of copying machines, existing photosensitive microencapsulated toners are not satisfactory with respect to their sensitivity. In particular, there is a demand for improving the sensitivity of microcapsules which are sensitive to light at a wavelength of approximately 650 nm (red light).

SUMMARY OF THE INVENTION

An object of the present invention is to provide photosensitive microencapsulated toner which can solve the problems set out hereinabove and which encapsulates therein a photocurable composition capable of being cured at low energy by irradiation with visible light, and particularly light of a wavelength not lower than 600 nm.

In order to achieve the above purpose, the invention provides a photosensitive microencapsulated toner which comprises, as encapsulated, a radical polymerizable unsaturated group-containing compound, a metal arene compound, a spectral sensitizing dye and a photosensitizer.

The toner of the invention in the form of microcapsules is cured at an intended wavelength of light by the action of the spectral sensitizing dye. More particularly, upon image-wise exposure to light at a wavelength of about 650 nm (red light), the content of the photosensitive microencapsulated toner is solidified. When the microcapsules in non-exposed portions are ruptured and transferred to a material to be transferred, an image can be recorded.

As will be apparent from the above, the photosensitive microencapsulated toner of the invention is capable of being cured by application of visible light, particularly light of a wavelength not lower than 600 nm, with low energy. Thus, the exposure time can be shortened and the toner is able to successfully cope with high speed operation of an image forming apparatus.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENT

One embodiment of the invention is described with reference to the accompanying drawings.

Figure 1:
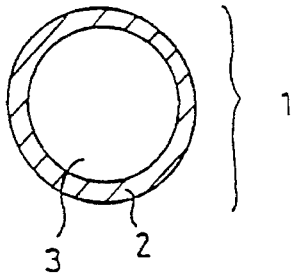
FIG. 1 is an enlarged sectional view of a photosensitive microencapsulated toner particle.

FIG. 1 shows an enlarged sectional view of a photosensitive microencapsulated toner particle. A photosensitive toner microcapsule I has a structure which includes an outer shell 2 and a photosensitive composition 3 filled in the outer shell 2. The photosensitive composition 3 comprises, at least, a radical polymerizable unsaturated group-containing compound, a metal arene compound serving as a photopolymerization initiator, a spectral sensitizing dye, and a photosensitizer.

The photosensitive composition includes 100 parts by weight of the radical polymerizable unsaturated group-containing compound, 0.01–60 parts by weight of the metal arene compound as the photopolymerization initiator, 0.005–50 parts by weight of the spectral sensitizing dye and 0.005–50 parts by weight of the photosensitizer. More preferably, the photosensitive composition includes 100 parts by weight of the radical polymerizable unsaturated group-containing compound, 0.1–20 parts by weight of the metal arene compound, 0.01–10 parts by weight of the spectral sensitizing dye, and 0.01–10 parts by weight of the photopolymerization initiator.

The curing reaction mechanism of the toner contained in the microcapsules is not fully understood, but is assumed to proceed substantially as follows. Initially, the spectral sensitizing dye absorbs light and is excited. When the thus excited dye returns to its ground state, the metal arene compound is activated by the migration of electrons or energy. The activated metal arene compound acts to produce radicals from the photosensitizer and the radical polymerizable unsaturated group-containing compound. The radicals in turn polymerize the radical polymerizable unsaturated group-containing compound. The photosensitizer may, in some cases, serve as a quencher for oxygen radicals which may deactivate the produced radicals.

Useful radical polymerizable unsaturated group-containing compounds include, for example, N-vinyl-2-pyrrolidone, mixtures of polyethylene glycol diacrylate and dipentaerythritol hexaacrylate, bisphenol A diacrylate and dimethacrylate, tripropylene glycol diacrylate and dimethacrylate, pentaerythritol triacrylate and trimethacrylate, dipentaerythritol hexaacrylate and hexamethacrylate, trimethylolpropane triacrylate and trimethacrylate, and the like. These compounds may be used singly or in combination.

Useful metal arene compounds are compounds which have, for example, the following structure:

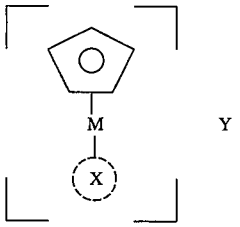

Y [Formula 1]

wherein X represents a group containing at least one benzene ring, Y represents a basic ion such as $BF_4^-$, $PF_6^-$, $AsF_6^-$ or $SbF_6^-$, and M is a metal such as iron, nickel or cobalt.

Useful spectral sensitizing dyes include, for example, xanthene dyes, coumarin dyes, merocyanine dyes, thiazine dyes, azine dyes, methine dyes, oxazine dyes, phenylmethane dyes, cyanine dyes, azo dyes, anthraquinone dyes, pyrazoline dyes, stilbene dyes, quinoline dyes and the like. Of these, xanthene dyes, coumarin dyes, merocyanine dyes, thiazine dyes, azine dyes, methine dyes and oxazine dyes are preferred.

Useful photosensitizers may be compounds having the following structure:

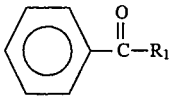

[Formula 2]

wherein $R_1$ represents a substituted or unsubstituted hydrocarbon group, or a ketone group. Examples of such compounds include diketones such as benzil and methylbenzoyl formats, and acetophenones such as 2,2-dimethoxy-2-phenylacetophenone and 2-hydroxy-2-methylpropiophenone.

Alternatively, aromatic iodonium salts having the following structure may be used:

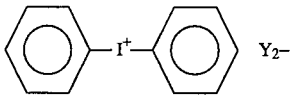

[Formula 3]

wherein $Y_2^-$ represents a monovalent anion such as a halogen ion, a hydroxyl ion, $HSO_4^-$, $BF_4^-$, $PF_6^-$ or $AsF_6^-$. Examples of these compounds include aromatic iodonium salts such as diphenyliodonium bromide, diphenyliodonium chloride, diphenyliodonium tetrafluoroborate, diphenyliodonium hexafluorophosphate, and the like.

The photosensitive microencapsulated toner may further comprise, if necessary, thermal polymerization inhibitors, other sensitizers, surface active agents, solvents, dyes and pigments, microcapsule wall-forming agents, and the like, provided that they do not impede the toner's photosensitive characteristics.

The toner of this embodiment may be prepared by any procedures known in the art such as set forth, for example, in U.S. Pat. Nos. 2,730,456, 2,800,457, 2,800,458, 2,969,331, 3,111,407, 3,281,383, 3,287,154, 3,418,250, 3,551,346, 3,576,660, 3,578,605, 3,660,304, 3,726,803, 3,755,190, 3,773,695, 3,793,268, 3,796,669, 3,803,046, 3,816,331, 4,001,140, 4,025,455, 4,087,376, 4,089,802 and 4,079,066, British Patent Nos. 927,807, 930,422, 965,074 and 990,443, Canadian Patent No. 879,043, and Japanese Patent Publication Nos. 36-9168, 38-19574, 42-446, 42-771, 48-40347, 49-24159 and 51-28589. However, useful methods of preparing the toners are not limited to the methods described in these publications. The outer wall-forming material should preferably have the properties of transmitting light.

The photosensitive microencapsulated toner of the preferred embodiment is more particularly described in the following examples.

EXAMPLE 1

10 parts by weight of a mixture of polyethylene glycol diacrylate (M240 manufactured by TOAGOSEI CHEMICAL INDUSTRY CO., LTD.) and dipentaerythritol hexaacrylate (M400 manufactured by TOAGOSEI CHEMICAL INDUSTRY CO., LTD.) at a ratio of 3:4, both used as a radical polymerizable unsaturated group-containing compound, 1.5 parts by weight of an iron arene compound of Formula 4 used as a polymerization initiator, 0.1 part by weight of methylene blue serving as a spectral sensitizing agent, and 0.5 part by weight of a benzil sensitizer were mixed, followed by ultrasonic dispersion for 5 minutes and heating at 100° C. for 10 minutes, to obtain the photosensitive composition 3.

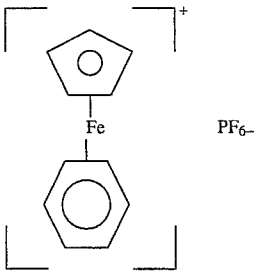

[Formula 4]

0.2% of adipic acid was dissolved in the above composition, to provide a core substance for the toner.

30% of polyoxyethylene sorbitan tristearate (Rheodol TW-S320 manufactured by Kao Corporation) and 0.2% of hexamethylenediamine were dissolved in 100 g of water.

50g of the core substance were subjected to emulsification and dispersion in 100 g of the resultant aqueous solution, followed by polymerization to form a wall material at the interfaces between the core substance and the aqueous solution, and obtain microcapsules. The microcapsules were dried and recovered, to obtain a photosensitive microencapsulated toner.

Figure 2:
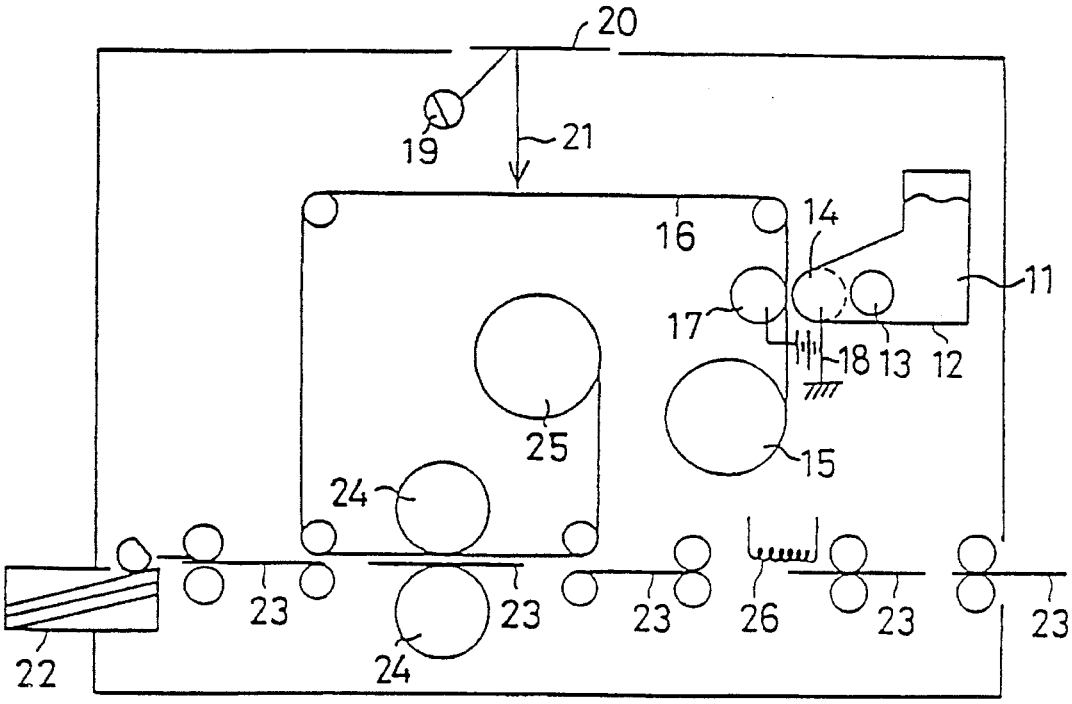
FIG. 2 is a schematic sectional view of an image forming apparatus using photosensitive microencapsulated toner particles of the preferred embodiment.

With reference to FIG. 2 which is a schematic sectional view showing an example of an image forming apparatus in which the photosensitive microencapsulated toner of the preferred embodiment is used, the image formation process using the toner of the preferred embodiment will be explained.

A photosensitive microencapsulated toner 11 of the example is sealed in a toner tank 12 having a rotatable charging roller 13. The toner 11 in the toner tank 12 includes a mixture of three toners, i.e., photosensitive yellow microencapsulated toner, photosensitive magenta microencapsulated toner and photosensitive cyan toner, which are uniformly mixed in equal amounts. The rotation of the charging roller 13 will cause the toner particles 11 to be in frictional contact with each other, thereby electrically charging the particles. The charged toner or toner particles 11 are carried from the inside of the toner tank 12 to the tip thereof by means of a support roller 14 rotatably disposed in toner tank 12.

A polyethylene terephthalate (hereinafter referred to as "PET") sheet 16 wound out from a PET roll 15 is fed between the support roller 14 and a counter roller 17 located symmetrically with respect to the PET sheet 16. The toner 11 is electrostatically applied to the PET sheet 16, on the surface of PET sheet 16 facing the support roller 14, by means of electrodes 18 attached to the support roller 14 and the counter roller 17.

Light from a light source 19 is irradiated on an image-containing original 20 and the toner-applied surface of the PET sheet 16 is subjected to image-wise exposure to the resultant reflected light 21. By this exposure, the toner 11 is solidified in portions where it is exposed to light 21. Thus, a latent image is formed on the PET sheet 16.

The latent image-bearing surface of the PET sheet 16 and a recording medium 23 fed from a paper feed cassette 22 are brought into intimate contact with each other. In this contacted state, the PET sheet 16 and the recording medium 23 are held between a pair of press rollers 24, whereupon the microencapsulated toners 11 which remain unreacted are ruptured by the application of nip pressure exerted from the press rollers 24. The core substances of the ruptured toners 11 are deposited on the recording medium 23 to permit an image to be transferred onto the recording medium 23. Thereafter, the PET sheet 16 is wound up onto a take-up roller 25. The image transferred onto the recording medium 23 is fixed thereon by means of a non-contact type heat fixing unit 26. The thus formed image-bearing medium 23 is then transferred out of the apparatus.

In this manner, the whole recording procedure using the toner of the preferred embodiment is completed. The curing energy of the toner was found to be 1572.24 erg/cm$^2$ at a maximum curing wavelength of 670 nm.

Comparative Example

The general procedure of Example 1 was repeated except that benzil was not used, thereby obtaining a photosensitive microencapsulated toner. The results of measurement of the curing energy revealed that at a maximum curing wavelength of 670 nm, the curing energy was 2207.09 erg/cm$^2$, which was as great as 1.4 times that employed in Example 1.

Example 2

The general procedure of Example 1 was repeated except that Basic Blue 3 was used instead of methylene blue and 2,2-dimethoxy-2-phenylacetophenone was used instead of benzil, thereby obtaining a photosensitive microencapsulated toner. The results of measurement of the curing energy revealed that at a maximum curing wavelength of 660 nm, the curing energy was 1698.63 erg/cm$^2$.

Example 3

The general procedure of Example 1 was repeated except that diphenyliodonium bromide was used instead of benzil, thereby obtaining a photosensitive microencapsulated toner. The results of measurement of the curing energy revealed that at a maximum curing wavelength of 670 nm, the curing energy was 1697.59 erg/cm$^2$.

The present invention should not be construed as being limited to these examples and may be further varied and modified without departing from the scope of the invention as defined in the appended claims. For example, the wall layer of the microcapsules may have a double-layered structure. Furthermore, various additional functions may be imparted to the outer shell of the microcapsules. For example, the outer shell of the microcapsules may be imparted with self-adhesiveness or a magnetic field. Likewise, functional properties may further be added to the outside of the outer shells of the microcapsules. In addition, the radical polymerizable unsaturated group-containing compound may be solid in nature. If solid, the compound is thermally molten at the time of photoreaction.

What is claimed is:

1. Photosensitive microencapsulated toner, comprising:

an outer shell; and a photocurable composition filled in the outer shell, the photocurable composition comprising:

(a) a radical polymerizable unsaturated group-containing compound, (b) metal arene compound as a photopolymerization initiator, (c) a spectral sensitizing dye, and (d) photosensitizer that is not a spectral sensitizing dye, wherein said photocurable composition is curable with light of a wavelength not lower than 600 nm.

2. Photosensitive microencapsulated toner according to claim 1, wherein said photosensitizer has a structure described by the following formula:

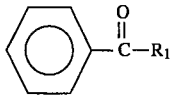

wherein $R_1$ represents a substituted or unsubstituted hydrocarbon group, or a ketone group.

3. Photosensitive microencapsulated toner according to claim 2, wherein said photosensitizer is selected from the group consisting of diketones and acetophenones.

4. Photosensitive microencapsulated toner according to claim 1, wherein said photosensitizer is an aromatic iodonium salt having a structure described by the following formula:

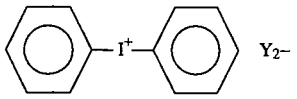

wherein $Y_2^-$ represents a monovalent anion selected from the group consisting of a halogen ion, a hydroxyl ion, $HSO_4^-$, $BF_4^-$, $PF_6^-$ and $AsF_6^-$.

5. Photosensitive microencapsulated toner according to claim 4, wherein said aromatic iodonium salt is selected from the group consisting of diphenyliodonium bromide, diphenyliodonium chloride, diphenyliodonium tetrafluoroborate, and diphenyliodonium hexafluorophosphate.

6. Photosensitive microencapsulated toner according to claim 1, wherein the photocurable composition contains about 100 parts by weight of the radical polymerizable unsaturated group-containing compound, about 0.01 to 60 parts by weight of the metal arene compound, about 0.005 to 50 parts by weight of the spectral sensitizing dye, and about 0.005 to 50 parts by weight of the photosensitizer.

7. Photosensitive microencapsulated toner according to claim 1, wherein the photocurable composition contains about 100 parts by weight of the radical polymerizable unsaturated group-containing compound, about 0.1 to 20 parts by weight of the metal arene compound, about 0.01 to 10 parts by weight of the spectral sensitizing dye, and about 0.01 to 10 parts by weight of the photosensitizer.

8. Photosensitive microencapsulated toner according to claim 3, wherein the photosensitizer is a diketone selected from the group consisting of benzil and methylbenzoyl formats.

9. Photosensitive microencapsulated toner according to claim 3, wherein the photosensitizer is an acetophenone selected from the group consisting of 2,2-dimethoxy-2-phenylacetophenone and 2-hydroxy-2-methylpropiophenone.

10. Photosensitive microencapsulated toner according to claim 1, wherein the polymerizable unsaturated group-containing compound is selected from the group consisting of N-vinyl-2-pyrrolidone, polyethylene glycol diacrylate, dipentaerythritol hexaacrylate, bisphenol A diacrylate, dimethacrylate, tripropylene glycol diacrylate, pentaerythritol triacrylate, trimethacrylate, hexamethacrylate, trimethylolpropane triacrylate, and mixtures thereof.

11. Photosensitive microencapsulated toner according to claim 1, wherein the metal arene compound has a structure represented by the following formula:

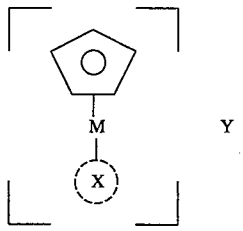

wherein X represents a group containing at least one benzene ring, Y represents a basic ion, and M represents a metal.

12. Photosensitive microencapsulated toner according to claim 11, wherein Y represents a basic ion selected from the group consisting of $BF_4^-$, $PF_6^-$, $AsF_6^-$ and $SbF_6^-$.

13. Photosensitive microencapsulated toner according to claim 11, wherein M represents a metal selected from the group consisting of iron, nickel and cobalt.

14. Photosensitive microencapsulated toner according to claim 1, wherein the spectral sensitizing dye is selected from the group consisting of xanthene dyes, coumarin dyes, merocyanine dyes, thiazine dyes, azine dyes, methine dyes, oxazine dyes, phenylmethane dyes, cyanine dyes, azo dyes, anthraquinone dyes, pyrazoline dyes, stilbene dyes, quinoline dyes, and mixtures thereof.

15. Photosensitive microencapsulated toner, comprising a photocurable core composition that contains:

(a) about 100 parts by weight of a radical polymerizable unsaturated group-containing compound;

(b) about 0.01 to 60 parts by weight of a metal arene compound;

(c) about 0.005 to 50 parts by weight of a spectral sensitizing dye; and (d) about 0.005 to 50 parts by weight of a photosensitizer that is not a spectral sensitizing dye.

16. Photosensitive microencapsulated toner according to claim 15, wherein said photosensitizer has a structure described by the following formula:

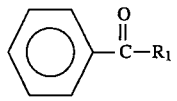

wherein $R_1$ represents a substituted or unsubstituted hydrocarbon group, or a ketone group.

17. Photosensitive microencapsulated toner according to claim 15, wherein said photosensitizer is an aromatic iodonium salt having a structure described by the following formula:

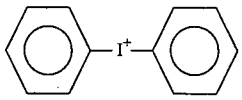

wherein $Y_2^-$ represents a monovalent anion selected from the group consisting of a halogen ion, a hydroxyl ion, $HSO_4^-$, $BF_4^-$, $PF_6^-$ and $AsF_6^-$.

18. Photosensitive microencapsulated toner according to claim 1, wherein said photosensitizer is a ketone or an aromatic iodonium salt.

19. Photosensitive microencapsulated toner according to claim 15, wherein said photosensitizer is a ketone or an aromatic iodonium salt.

20. Photosensitive microencapsulated toner, comprising:

an outer shell; and a photocurable composition filled in the outer shell, the photocurable composition comprising a radical polymerizable unsaturated group-containing compound, a metal arene compound as a photopolymerization initiator, a spectral sensitizing dye, and a photosensitizer selected from the group consisting of (1) photosensitizers having a structure described by the following formula:

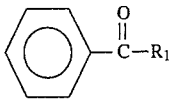

wherein $R_1$ represents a substituted or unsubstituted hydrocarbon group, or a ketone group, and (2) aromatic iodonium salts having a structure described by the following formula:

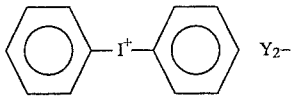

wherein $Y_2^-$ represents a monovalent anion selected from the group consisting of a halogen ion, a hydroxyl ion, $HSO_4^-$, $BF_4^-$, $PF_6^-$ and $AsF_6^-$.

* * * * *